US006737567B2

(12) United States Patent
Steinbuhler

(10) Patent No.: US 6,737,567 B2
(45) Date of Patent: May 18, 2004

(54) SOSTENUTO ROD BRACKET

(76) Inventor: David Steinbuhler, 215 W. Walnut St., Titusville, PA (US) 16354

( * ) Notice: Subject to any disclaimer, the term of this patent is extended or adjusted under 35 U.S.C. 154(b) by 0 days.

(21) Appl. No.: 10/218,023

(22) Filed: Aug. 12, 2002

(65) Prior Publication Data

US 2003/0131709 A1 Jul. 17, 2003

Related U.S. Application Data

(60) Provisional application No. 60/349,669, filed on Jan. 16, 2002.

(51) Int. Cl.[7] ..... G10C 3/00
(52) U.S. Cl. ..... 84/216; 84/217
(58) Field of Search ..... 84/216, 217, 218, 84/219, 220, 221, 222, 223, 224

(56) References Cited

U.S. PATENT DOCUMENTS 6,011,214 A * 1/2000 Kawamura ..... 84/719
6,448,481 B2 * 9/2002 Maehara et al. ..... 84/225

* cited by examiner

*Primary Examiner*—Kimberly Lockett
(74) *Attorney, Agent, or Firm*—Reed Smith LLP

(57) ABSTRACT

In a piano that includes an action frame and a sostenuto rod bracket, the sostenuto rod bracket being adapted to accommodate a sostenuto rod, an improvement involving the attachment of the sostenuto rod bracket to the action frame. Increased access to the sostenuto rod bracket can be facilitated simply by detaching the action stack bracket from the action frame.

6 Claims, 1 Drawing Sheet

SOSTENUTO ROD BRACKET

CROSS-REFERENCE TO RELATED APPLICATION

This application claims priority from U.S. Provisional Patent Application Serial No. 60/349,669, filed on Jan. 16, 2002.

FIELD OF THE INVENTION

The present invention generally relates to pianos and associated arrangements employed for mounting a sostenuto rod.

BACKGROUND OF THE INVENTION

Typically, a grand piano, such as a Steinway piano, includes a keyboard comprised of a set of keys mounted on a frame to which is mounted the piano's action stack. The action stack contains all the hammers that strike the piano's strings and produce the piano's sound. Taken together, the action stack and the piano's keyboard form a complete unit in a grand piano called the "piano's action" and, normally, this unit is easily removed from the piano. When providing a replacement keyboard for a grand piano (particularly Steinway pianos), a sostenuto rod is typically supplied as part of the action. (A "sostenuto rod", associated with a sostenuto pedal, will be well-known to one of ordinary skill in the art and, thus, would not appear to warrant further discussion herein.)

A need has been recognized in connection with providing an improved sostenuto rod bracket arrangement.

SUMMARY OF THE INVENTION

The present invention, in accordance with at least one presently preferred embodiment, involves improvements in the manner of mounting a sostenuto rod to the action in a grand piano, such as a Steinway piano.

Generally, there is broadly contemplated in accordance with at least one presently preferred embodiment of the present invention, in a piano comprising an action frame and a sostenuto rod bracket, the sostenuto rod bracket being adapted to accommodate a sostenuto rod, the improvement comprising: the sostenuto rod bracket being attached to the action frame.

Further, there is broadly contemplated in accordance with at least one presently preferred embodiment of the present invention, Method of providing for the mounting of a sostenuto rod in a piano, the method comprising: providing an action frame; providing a sostenuto rod bracket, the sostenuto rod bracket being adapted to accommodate a sostenuto rod; and attaching the sostenuto rod bracket to the action frame.

Additionally, there is broadly contemplated in accordance with at least one presently preferred embodiment of the present invention, an action stack bracket for a piano, the action stack bracket comprising: a main body; and a front leg extending from the main body; the front leg being pivotable with respect to the main body to accommodate angled key shanks in a piano.

BRIEF DESCRIPTION OF THE DRAWINGS

The present invention and its presently preferred embodiments will be better understood by way of reference to the detailed disclosure herebelow and to the accompanying drawings, wherein.

DESCRIPTION OF THE PREFERRED EMBODIMENTS

Figure 1:
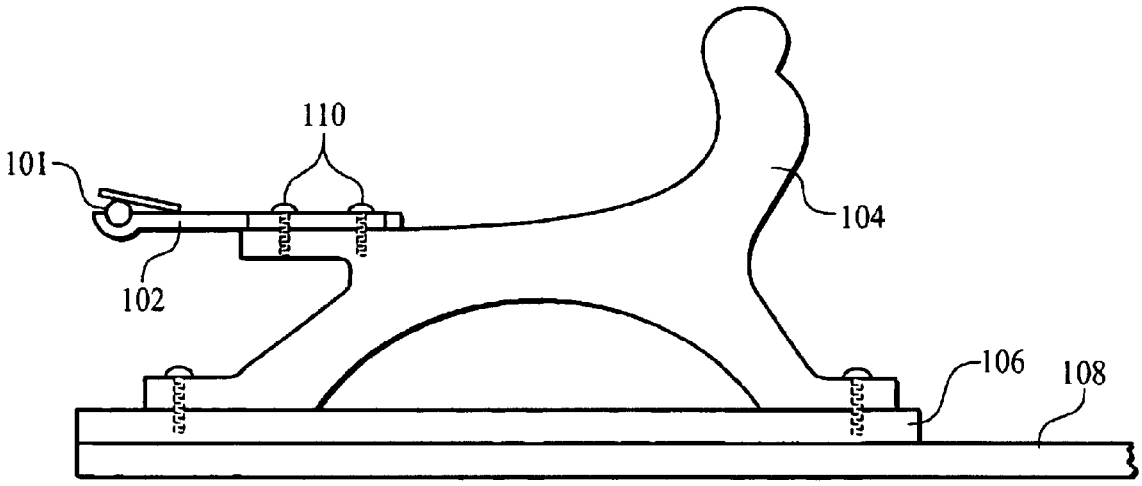
FIG. 1 is a side view of a conventional arrangement including a sostenuto rod bracket.

FIG. 1 is a side view of a conventional arrangement including a sostenuto rod bracket.

Typically, in a grand piano such as a Steinway piano), a sostenuto rod 101 is mounted on a sostenuto rod bracket 102, which itself is mounted onto an action stack bracket 104.

Figure 2:
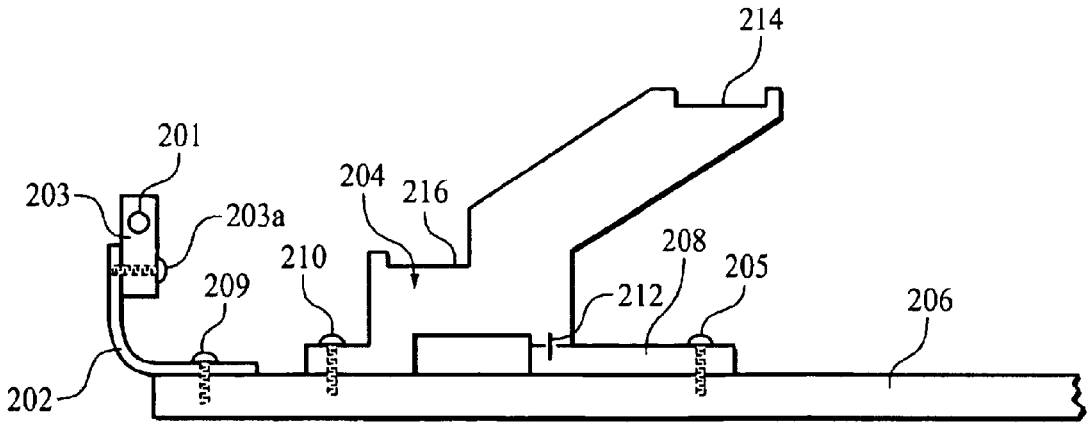
FIG. 2 is a side view of a different arrangement involving a sostenuto rod bracket.

However, as shown in FIG. 2, at least one embodiment of the present invention involves the use of a sostenuto rod bracket 202 which is mounted to the frame 206 of the action and not to the action stack bracket 204. Such a configuration is believed to greatly improve the ease of regulating the sostenuto rod 201, which generally needs to be adjustable forwards and rearwards (i.e., left to right, and right to left, respectively, in the drawing) as well as upwards and downwards. (Typically, slots in a sostenuto rod bracket permit such adjustment.)

In a grand piano such as a Steinway, it is usually difficult to adjust the sostenuto rod because, once the keyboard is in the piano, the action stack (with its action stack brackets) impedes access to the mounting screws of the sostenuto rod bracket (see FIG. 1).

However, as shown in FIG. 2, it is contemplated in accordance with at least one presently preferred embodiment of the present invention that the keyboard be insertable into the piano with the action stack removed. Since the sostenuto rod 201 is not attached to the action stack bracket 204, it will still be mounted to the action (at frame 206) and will be freely adjustable while still affording unimpeded access to the mounting screws 209 and 203*a* of the sostenuto rod bracket 202.

It will be appreciated that, among the advantages of a sostenuto rod bracket in accordance with at least one embodiment of the present invention, is the fact that the sostenuto rod bracket 202 (see FIG. 2) can be much more easily accessed, than in the case of a conventional arrangement (see FIG. 1, at 102). It is believed that, as such, technicians or other individuals who need to access a sostenuto rod bracket will find that much more room can be made available for the purpose in connection with an inventive arrangement (e.g., as in FIG. 2) than in a conventional arrangement (e.g., as in FIG. 1). The reason for this is that, in accordance with a preferred embodiment of the present invention, action stack bracket 204 may be easily removed (e.g. via screws at 205 and 210) in its entirety, thus providing free and clear access to sostenuto rod bracket 202. On the other hand, in the case of the conventional arrangement depicted in FIG. 1, sostenuto rod bracket 102 is attached to the action stack bracket 104, thus requiring the technician to maneuver around the action stack bracket 104 in order to access sostenuto rod bracket 102.

It will now also be appreciated that, among the advantages of a sostenuto rod bracket in accordance with at least one embodiment of the present invention, is the fact that the sostenuto rod bracket 202 (see FIG. 2) can provide greater degrees of sostenuto rod adjustment, than in the case of a conventional arrangement (see FIG. 1, at 102). To this end, sostenuto rod bracket 202 may preferably be mounted on action frame 206 via a screw 209 or other suitable mounting element, which itself will permit the bracket 202 to be adjustable front-to-back (i.e., right to left and back in the drawing), e.g., via a slot provided in bracket 202 in the vicinity of screw 209. Sostenuto rod 201 itself may be mountable in a suitable block 203 which is attached to bracket 202 via a suitable mounting element such as screw

203*a* and itself may be adjustable vertically, e.g. via a slot provided in block 203 for the purpose. As can be appreciated from FIG. 1, conventional arrangements tend not to have provided such versatility of adjustment.

However, it should also be understood that a sostenuto rod bracket, in accordance with at least one embodiment of the present invention, need not necessarily be shaped and configured in the manner shown in FIG. 2. Essentially any shape, orientation or positioning of a sostenuto rod bracket is conceivable in accordance with at least one embodiment of the present invention provided that the sostenuto rod bracket is connected to the action frame, and not to the action stack bracket, as shown.

However, the action stack bracket 204 could, in accordance with an embodiment of the present invention, preferably be shaped as shown. In this vein, the action stack bracket 204 could preferably be so configured as to accommodate angled key shanks such as may be found in a reduced-size keyboard, e.g. in reduced-size keyboards such as those described in U.S. Pat. No. 5,847,301 to Steinbuhler. A front leg 208 of the action stack bracket may pivot to accommodate angled key shanks. This front leg is preferably connected to the main body of the action stack bracket (e.g., via screw or other suitable mounting element 205) at a position corresponding to a line defined by capstan screws on the key shanks.

In FIG. 2, the pivotable front leg 208 is shown in a frontward orientation, i.e., lying in a direction essentially parallel to the front-to-back dimension of the piano (which is the horizontal dimension in the drawing). As such, screw/mounting element 205 lies below the aforementioned line defined by capstan screws on the key shanks.

Essentially any suitable mechanism may be employed to afford the pivotable relationship of front leg 208 with respect to the rest of action stack bracket 204, e.g., via a screw or pivot connection at 212.

Action stack bracket may have an upper, forward groove 214 and lower, rearward groove 216. Upper groove 214 may preferably be configured for accommodating a rail to which hammers are attached while lower groove 216 may preferably be configured for accommodating a wooden rail that bears whippens. (Whippens, hammers and hammer shanks are known to those of ordinary skill in the art and will not be further discussed herein). Typically, four, five or six action stack brackets are provided in an action and together support 88 hammers corresponding to all of the piano keys.

The copending and commonly owned U.S. patent application entitled "Portable Keyboard", filed herewith, as well as the U.S. Provisional Patent Application No. 60/311,677 from which it claims priority, are hereby fully incorporated by reference herein as if set forth in its entirety herein, and discusses other general concepts which may be useful towards an understanding of the background relating to at least one embodiment of the present invention.

If not otherwise stated herein, it may be assumed that all components and/or processes described heretofore may, if appropriate, be considered to be interchangeable with similar components and/or processes disclosed elsewhere in the specification, unless an express indication is made to the contrary.

If not otherwise stated herein, any and all patents, patent publications, articles and other printed publications discussed or mentioned herein are hereby incorporated by reference as if set forth in their entirety herein.

It should be appreciated that the apparatus and method of the present invention may be configured and conducted as appropriate for any context at hand. The embodiments described above are to be considered in all respects only as illustrative and not restrictive. All changes which come within the meaning and range of equivalency of the claims are to be embraced within their scope.

What is claimed is:

1. In a piano comprising an action frame, and action stack bracket and a sostenuto rod bracket, said sostenuto rod bracket being adapted to accommodate a sostenuto rod, the improvement comprising:

said sostenuto rod bracket being attached to said action frame;

at least one mounting element for attaching said sostenuto rod bracket to said action frame;

said action stack bracket being attachable and detachable with respect to said action frame, whereby access to said sostenuto rod bracket is increased, and whereby detachment of said action stack bracket from said action frame facilitates access to said at least one mounting element.

2. The improvement according to claim 1, wherein the piano is a grand piano.

3. Method of providing for the mounting of a sostenuto rod in a piano, said method comprising:

providing an action frame;

providing a sostenuto rod bracket, said sostenuto rod bracket being adapted to accommodate a sostenuto rod;

providing an action stack bracket;

providing at least one mounting element for attaching said sostenuto rod bracket to said action frame;

attaching said sostenuto rod bracket to said action frame;

attaching said action stack bracket to said action frame;

detaching said action stack bracket from said action frame to increase access to said sostenuto rod bracket; and accessing said at least one mounting element upon detachment of said action stack bracket from said action frame.

4. The method according to claim 3, wherein the piano is a grand piano.

5. An action stack bracket for a piano, said action stack bracket comprising:

a main body;

a front leg extending from said main body; and said front leg being pivotable with respect to said main body to accommodate angled key shanks in a piano.

6. The action stack bracket according to claim 5, wherein:

said front leg being connected to said main body at a position corresponding to a line defined by capstan screws on key shanks in a piano.

* * * * *